US006504478B1

(12) United States Patent
Yen et al.

(10) Patent No.: US 6,504,478 B1
(45) Date of Patent: Jan. 7, 2003

(54) EARTH STRATUM FLUSH MONITORING METHOD AND A SYSTEM THEREOF

(76) Inventors: J. Y. Richard Yen, 9F-1, No. 118, Ta Chung Nan Street, West District, Taichung (TW); Kimble J. Chen, No. 1-206, Wu Chuan Road, Taichung (TW)

( * ) Notice: Subject to any disclaimer, the term of this patent is extended or adjusted under 35 U.S.C. 154(b) by 0 days.

(21) Appl. No.: 09/993,554

(22) Filed: Nov. 27, 2001

(51) Int. Cl.[7] ..... G08B 21/00

(52) U.S. Cl. ..... 340/540; 340/601; 340/604; 340/665

(58) Field of Search ..... 340/540, 601, 340/602, 604, 665, 690; 324/534

(56) References Cited

U.S. PATENT DOCUMENTS 3,902,155 A * 8/1975 Young ..... 340/5 R
4,136,556 A * 1/1979 Graham ..... 340/690
6,018,244 A * 1/2000 Kushida ..... 324/323
6,119,535 A * 9/2000 Tambo et al. ..... 73/865.8
6,188,222 B1 * 2/2001 Seydoux et al. ..... 324/339

* cited by examiner

*Primary Examiner*—Jeffery Hofsass
*Assistant Examiner*—Phung T Nguyen
(74) *Attorney, Agent, or Firm*—Rosenberg, Klein & Lee

(57) ABSTRACT

An earth stratum flush monitoring method and a system thereof. Multiple transmitter units are embedded in the earth stratum at predetermined depth intervals. When the earth stratum is flushed, the respective transmitter units will be one by one flushed and displaced and shocked or rotated in accordance with the change of flush depth of the earth stratum. A shock sensor in each transmitter unit will sense this shock. The radio signal transmitters of the transmitter units will emit different encoded radio signals. A signal receiving apparatus disposed on the ground receives the signals and a computer reads the signals so as to monitor and know the real-time flush depth of the earth stratum. The detected real-time flush depth is then transmitted to an early warning unit for the early warning unit to read and judge and emit an alarm in time.

5 Claims, 4 Drawing Sheets

EARTH STRATUM FLUSH MONITORING METHOD AND A SYSTEM THEREOF

BACKGROUND OF THE INVENTION

The present invention is related to an earth stratum flush monitoring method and a system thereof. Multiple transmitter units are embedded in the earth stratum at different predetermined locations. When the earth stratum is flushed, the respective transmitter units will buoy and displace to emit different signals. A signal receiving apparatus receives the signals to monitor and know the real-time flush depth and displacement of the earth stratum.

In a steep maintain district, when encountering a downpour, a flood often flushes the earth stratum to form Debris-flow which will result in damage of constructions and overflow in a depressed area. The Debris-flow will also damage transportation systems and bridges.

When designing a bridge, the depth of the basis of the foundations (piers or caissons) is determined in consideration of many factors including the change of the river gullet as well as the properties of the river. A bridge flush monitoring system is mainly used to real-time reflect the embedded depth of the foundations for judging the safety of the bridge.

The existent bridge foundation flush monitoring systems are of two types, that is, surface type and embedded type.

With respect to the surface type, some shortcomings exist as follows:

1. When mounting the monitoring sensors and necessary conduit systems to a bridge, the up-stream side of the piers and bridge foundations needs to be extensively excavated to expose the surface of the caisson or piles up to their total depth. It is therefore impractical to mount the monitoring sensors when working on either a constructing bridge or an existing bridge.
2. Mud, rock and alien objects transported by Debris-flow will exert a great impact onto the exposed monitoring sensors and conduits (containing therein power supply) and damage the monitoring system. Under such circumstance, the monitoring function will be lost. This may happen anytime during the history of a Debris-flow. Therefore, the measured maximum flush depth data may be interrupted and naturally is hardly reliable. More importantly, in case any damage takes place, it is necessary to excavate the earth and to restore the entire monitoring system again. It is expensive, time consuming, and laborious task.

With respect to the embedded type, some shortcomings exist as follows:

1. When mounted, it is necessary to drill holes on the cover plate of the foundation (usually made of substantially reinforced concrete) and it is very difficult.
2. The mechanical structures are subjected to difficult operation or failure or damage due to wear, misplacement and deformation of gear or chain.
3. Still a part of the pipeline and mechanical equipment must be embedded in one side of the foundation. The conduits and mechanical equipments are subject to impact of the flood. In addition, one side of the bridge foundation still needs to be extensively excavated.

Consequently, a new monitoring system is required to provide safe and reliable real-time earth stratum flush data at reasonable cost. Moreover, it should be easy to be placed anywhere in the river gullet. The monitoring system needs to be anti-impact and free from environmental condition during installation.

SUMMARY OF THE INVENTION

It is therefore a primary object of the present invention to provide an earth stratum flush monitoring method and a system thereof. Multiple transmitter units are embedded in the earth stratum at predetermined depths. When the earth stratum is flushed, the respective transmitter units will be one by one flushed and displaced and shocked or rotated in accordance with the change of flush depth of the earth stratum. A shock sensor in each transmitter unit will sense this shock and a series of specially encoded radio signals will be emitted. A computerized signal receiving apparatus placed at an appropriate location receives and decodes the signals so as to monitor and report the real-time flush depths of different locations of the earth stratum.

It is a further object of the present invention to provide the above earth stratum flush monitoring method and a system thereof in which the detected real-time flush depth is then transmitted to an early warning unit for the early warning unit to read and judge and emit an alarm in time.

The present invention can be best understood through the following description and accompanying drawings wherein:

DETAILED DESCRIPTION OF THE PREFERRED EMBODIMENTS

Please refer to FIGS. 1 to 4. The earth stratum flush monitoring system of the present invention includes multiple transmitter units 1, a radio receiving apparatus 2 and a early warning unit 3.

Figure 3:
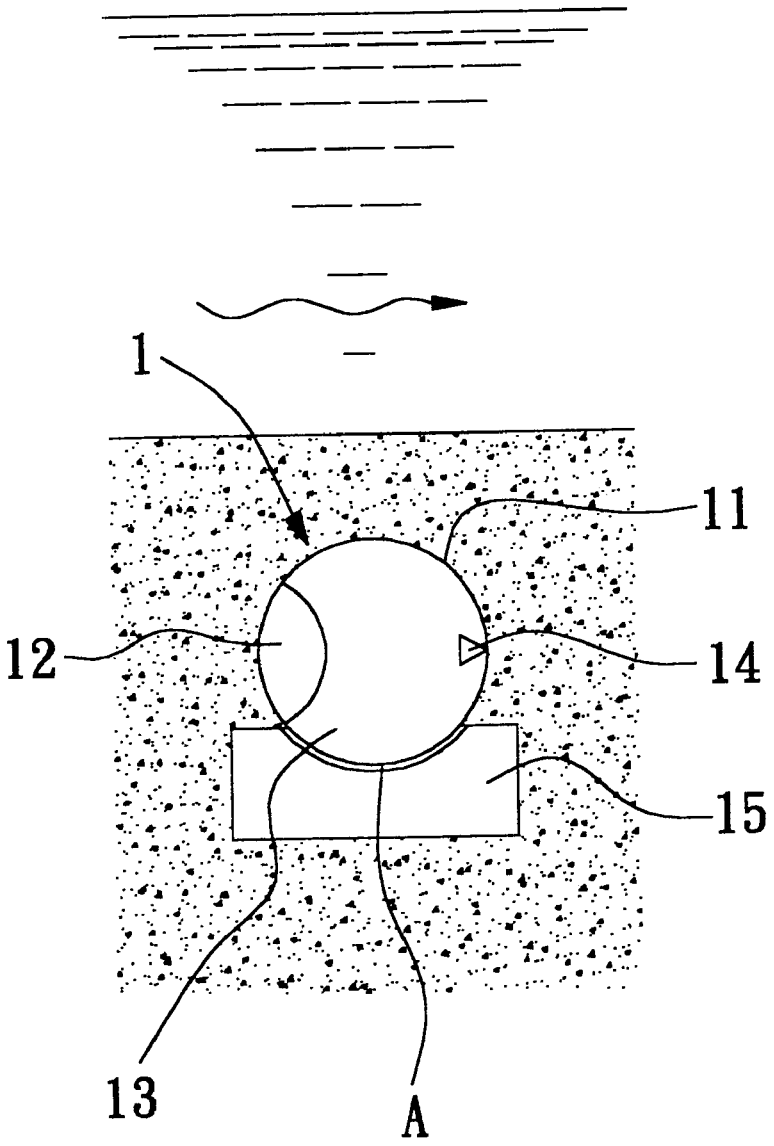
FIG. 3 shows that the transmitter unit of the present invention is adhered to the base seat and embedded in the earth stratum.
Figure 4:
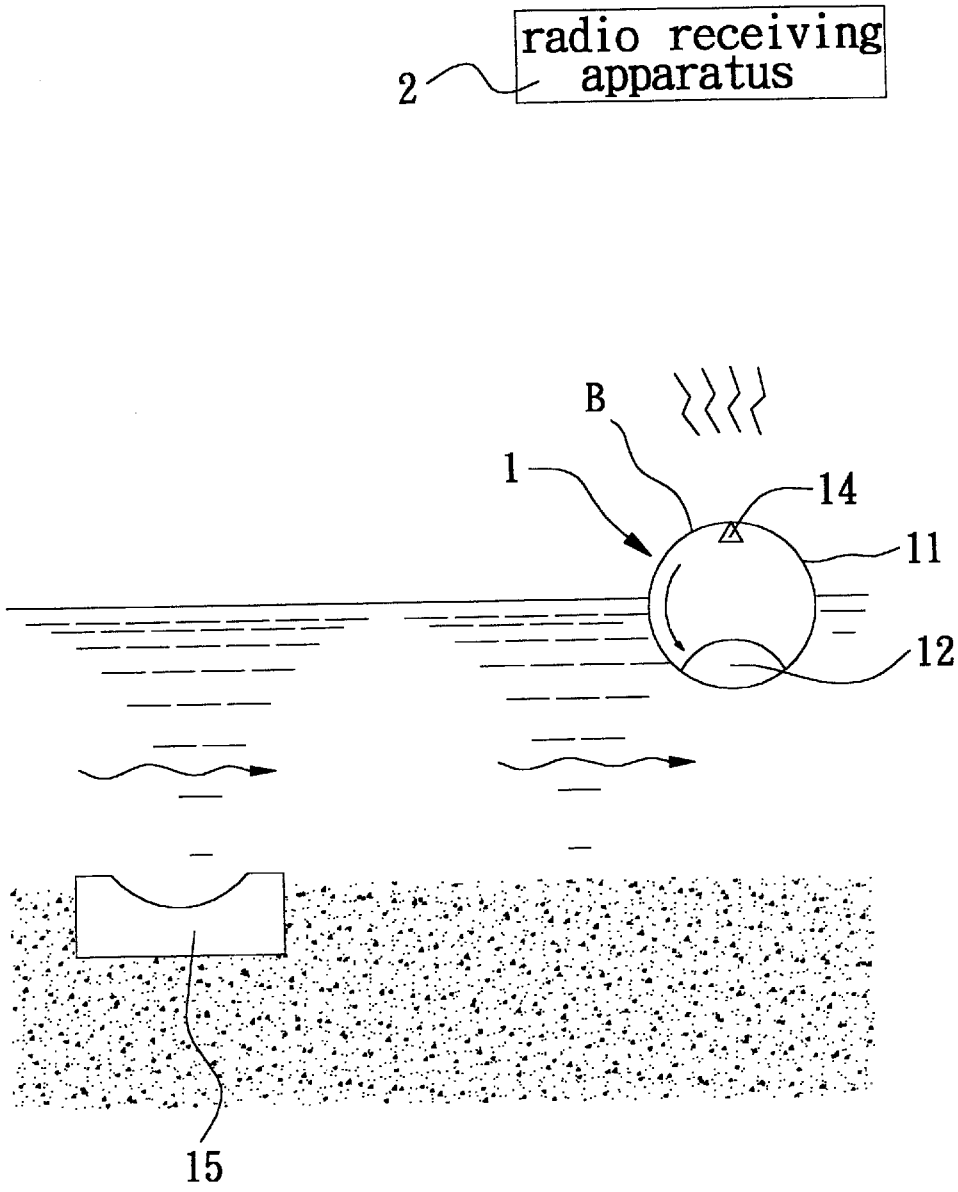
FIG. 4 shows that the transmitter unit of the present invention is flushed and buoys.

Each transmitter unit 1 includes a hollow spherical water-tight housing 11 made of anti-impact plastic material which is not subject to crack. In the housing 11 are disposed a weight block 12, a shock sensor 13 and a radio signal transmitter 14. In this embodiment, the shock sensor 13 is a vacuum magnetic switch. The transmitter unit 1 is such arranged that the specific weight thereof is smaller than one so that the transmitter unit 1 serves as a buoyant body. The weight block 12 is positioned on a lateral side or upper side of the transmitter unit 1 in a balanced, while unstable state as shown in FIG. 3. The transmitter unit 1 is adhered to a base seat 15 by hydrophilic gum A. The radio signal transmitter 14 contains therein a durable cell and an antenna. The antenna is disposed in the housing 11 on one side B thereof opposite to the weight block 12 as shown in FIG. 4. When the shock sensor 13 senses that the transmitter unit 1 is flushed and shocked or rotated, the radio signal transmitter 14 will transmit an encoded radio signal.

The radio receiving apparatus 2 serves to receive the encoded signal transmitted by the radio signal transmitter 14. The radio receiving apparatus 2 is connected with a computer 21 which reads and decodes the signal to be advised that the cell has been free from berried location and therefore obtain the real-time flush depth of the earth stratum.

The early warning unit 3 is connected with the computer 21 for receiving and judging the detected real-time flush depth so as to emit a warning signal in time.

Figure 1:
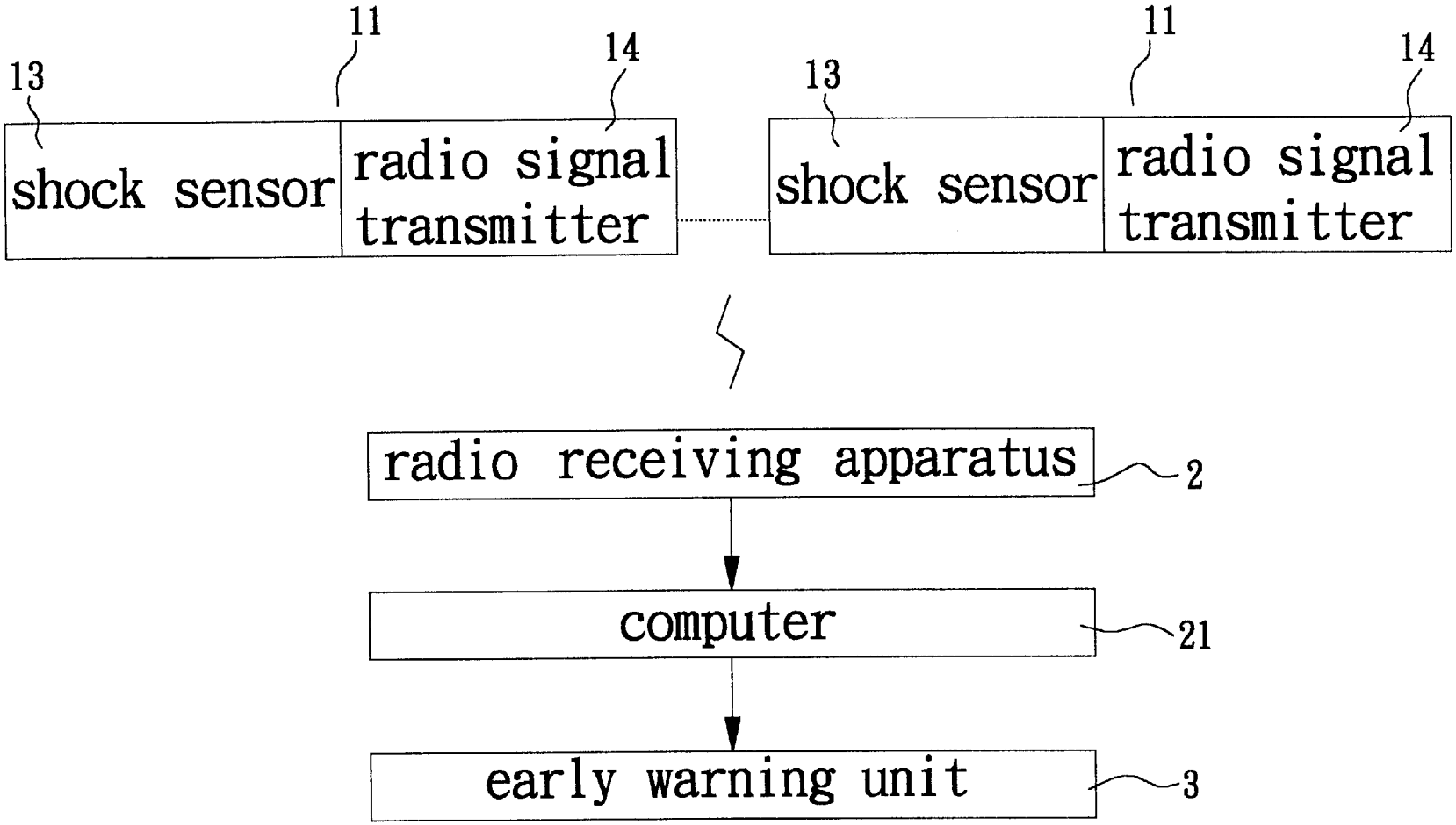
FIG. 1 is a block diagram of the layout of the earth stratum flush monitoring system of the present invention.
Figure 2:
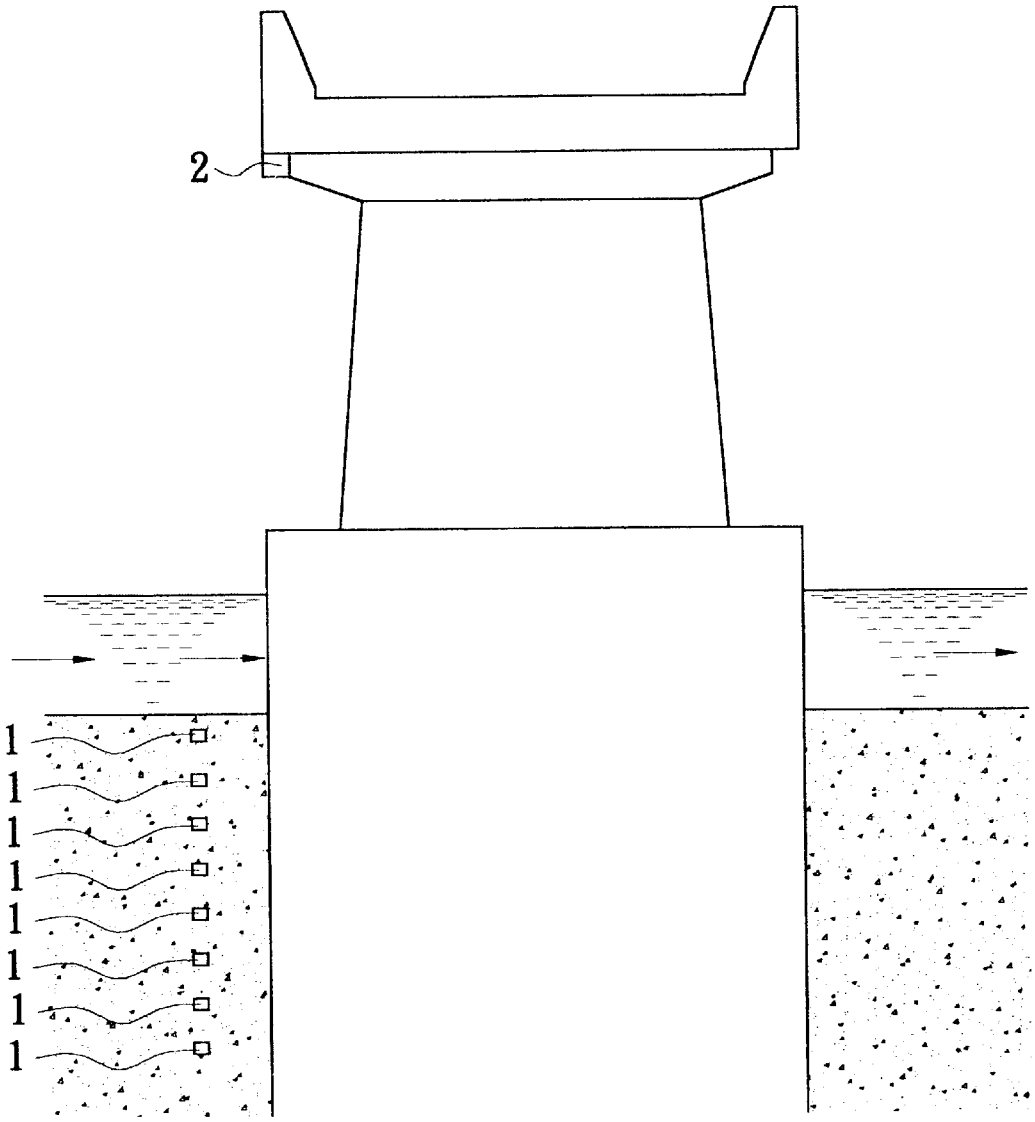
FIG. 2 shows that the earth stratum flush monitoring system of the present invention is embedded in the earth stratum.

The earth stratum flush monitoring method of the present invention is as follows:

Multiple transmitter units 1 with the base seats 15 are from sequentially embedded in the earth stratum through a pre-drilled vertical hole at predetermined depth intervals as shown in FIG. 2. When the earth stratum is flushed, the respective transmitter units 1 will be one by one flushed and displaced in accordance with the different flush depths of the earth stratum. When flushed, the transmitter units 1 will be shocked or rotated to respectively emit different encoded radio signals. The signal receiving apparatus 2 receive and decode the signals so as to monitor and know the real-time flush depth of the earth stratum. The detected real-time flush depth is then transmitted to the early warning unit 3 to emit warning signal in time.

For example, the earth stratum flush monitoring method and system of the present invention can be used to monitor the instantaneous real-time flush depth nearby a bridge pier. By means of standard working method commonly used in ground drilling engineering, multiple transmitter units 1 with the base seats 15 embedded in the earth stratum at predetermined depth intervals on about 50 cm~100 cm on the upstream side of the bridge pier. This place is generally where the maximum flush depth takes place. After the transmitter units 1 with the base seats 15 are embedded into the earth stratum, the hydrophilic gum A will be resolved. At this time, the transmitter units 1 are pressed by the earth and rocks of the earth stratum against the base seats 15 to keep the weight block 12 positioned on a lateral side or upper side of the transmitter unit 1 in a balanced, while unstable state. Under such circumstance, the shock sensor 13 is open.

When the river water continuously flushes the earth stratum, the flush depth will gradually increase and the respective transmitter units 1 are one by one flushed and exposed. When the transmitter units 1 are exposed and moved as shown in FIG. 4, since the transmitter units 1 are buoyant bodies which will buoy in the water. Moreover, the transmitter units 1 are embedded in the earth stratum with the weight block 12 positioned on a lateral side or upper side of the transmitter unit 1 in a balanced, while unstable state. Therefore, during flushing of the transmitter units 1, the transmitter units 1 will be impacted and shocked by the river flow. As a result, the transmitter units 1 will be rotated and shaken to make the weight block 12 directed downward in a balanced as well as stable state. The shock sensor 13 (vacuum magnetic switch) will sense the rotation or shock and be switched on. Thereafter, the power cut of the shock sensor 13 is avoided by SCR. The radio signal transmitter 14 transmits an encoded radio signal until the power is totally exhausted. The transmission power of the radio signal transmitter 14 is about 250 Mw and the effective covered radius within UHF wave band is about 3 Km. The durable cell contained in the radio signal transmitter 14 is lithium cell. After placed for 24 months, the cell can still have 65% power. In the case that the radio signal transmitter 14 has transmission power of 250 Mw, there should be 10 minutes of signal transmission time. When the transmitter unit 1 buoys, the antenna of the radio signal transmitter 14 will be directed upward to facilitate transmission of the radio signal.

The radio signal receiving apparatus 2 is generally safely placed on the bridge or at down stream locations. After the radio receiving apparatus 2 receives the radio signals transmitted by the radio signal transmitter 14, the respective transmitter units 1 embedded at different depths of the earth stratum will emit different signals. Therefore, the computer 21 can read and judge the depth at which the transmitter unit 1 is embedded in the earth stratum. Accordingly, the depth of the earth stratum flushed by the river flow can be known. Thereafter, via wire or wireless, the computer will transmit the detected flush depth data to the early warning unit 3 disposed in a disaster early warning center. The early warning unit 3 will read and judge the flush depth and emit alarm of appropriate levels in time according to the preset alarm value so as to avoid disaster.

After the transmitter unit 1 has been embedded for two years, the power of the durable lithium cell may be insufficient. At this time, new transmitter units 1 can be re-embedded into the earth stratum for further monitoring work. It is unnecessary to replace the entire system so that the cost is quite low.

The housing 11 of the transmitter unit 1 can be otherwise shaped as necessary. For example, when applied to earth stratum of a river gullet, the housing 11 can be spherical or cubic to meet the actual requirement.

Certainly, the earth stratum flush monitoring method and system of the present invention can be also applied to Debris-flow dangerous area for monitoring the speed and direction of the flow. Also, the earth stratum flush monitoring method and system of the present invention can be applied to the area where the river gullet changes for monitoring the possible condition of change of river gullet.

When applied to the Debris-flow dangerous area, by means of Doppler effect, the speed and direction of the flow can be detected. In case long time monitoring is required, a solar charging system can be additionally provided and connected to the respective transmitter units 1 by slenderer power wires to charge the batteries. When Debris flow takes place, the power wires will break and detach, permitting the transmitter units 1 to be flushed and displaced.

Moreover, the earth stratum flush monitoring system of the present invention can be also disposed in a river gullet for monitoring the change of hydrologic geologic environment of the river for a long time. In the case of such long term monitoring work, the early warning unit 3 is unnecessary and only the computer 21 records the data of flush depth as reference data for later river gullet engineering.

The above embodiment is only used to illustrate the present invention, not intended to limit the scope thereof. Many modifications of the above embodiment can be made without departing from the spirit of the present invention. For example, in addition to the signal receiving apparatus 2 mounted on the bridge, one or two receiving antennas can be further mounted on about 500 m downstream place of the bridge as spare one. After received, the signals are unified and transmitted via wire or wireless measure to the computer 21 for processing and analysis.

What is claimed is:

1. An earth stratum flush monitoring method in which multiple transmitter units are embedded in the earth stratum at predetermined depth intervals, whereby when the earth stratum is flushed, the respective transmitter units will be one by one flushed and displaced in accordance with the different flush depths of the earth stratum and when flushed, the transmitter units will be shocked or rotated to respectively emit different encoded radio signals, a signal receiving apparatus disposed on the ground receiving and decoding the signals so as to monitor and know the real-time flush depth of the earth stratum the detected real-time flush depth being then transmitted to an early warning unit to emit an alarm in time.

2. An earth stratum flush monitoring system comprising:

multiple transmitter units each including a watertight housing, the housing having a weight block, a shock sensor and a radio signal transmitter disposed therein, the radio signal transmitter containing a durable cell therein, whereby when the shock sensor senses that the transmitter unit is flushed and shocked or rotated, the radio signal transmitter transmits an encoded radio signal, each transmitter unit manufactured that the specific weigh thereof is smaller than one so that the transmitter unit serves as a buoyant body;

a radio receiving apparatus serving to receive the encoded signal transmitted by the radio signal transmitter, the radio receiving apparatus being connected with a computer which read the encoded signal to obtain the real-time flush depth of the earth stratum; and an early warning unit connected with the computer for receiving and judging the detected real-time flush depth so as to emit an alarm in time.

3. An earth stratum flush monitoring system comprising:

multiple transmitter units each including a watertight housing, the housing having a weight block, a shock sensor and a radio signal transmitter disposed therein, the radio signal transmitter containing a durable cell therein, whereby when the shock sensor senses that the transmitter unit is flushed and shocked or rotated, the radio signal transmitter transmits an encoded radio signal, the weight block being positioned in the housing of the transmitter unit on one side thereof in a balanced, while unstable state, the transmitter unit being adhered to a base seat by hydrophilic gum, whereby after the transmitter units with the base seats are embedded into an earth stratum, the hydrophilic gum will be resolved and after the earth stratum is flushed, the transmitter units will be shocked and rotated or displaced and the shock sensor will sense this and the radio signal transmitter will transmit an encoded radio signal; and, a radio receiving apparatus serving to receive the encoded signal transmitted by the radio signal transmitter, the radio receiving apparatus being connected with a computer which read the encoded signal to obtain the real-time flush depth of the earth stratum.

4. The earth stratum flush monitoring system as claimed in claim 2, wherein the shock sensor is a vacuum magnetic switch.

5. The earth stratum flush monitoring system as claimed in claim 2, wherein the antenna of the radio signal transmitter is disposed in the housing on one side thereof opposite to the weight block, whereby when the transmitter unit buoys, the antenna of the radio signal transmitter is directed upward to facilitate transmission of the radio signal.

* * * * *